US005371830A

United States Patent [19]

Wachenheim

[11] Patent Number: 5,371,830

[45] Date of Patent: Dec. 6, 1994

[54] HIGH-EFFICIENCY INFRARED ELECTRIC LIQUID-HEATER

[75] Inventor: Howard W. Wachenheim, Ball Ground, Ga.

[73] Assignee: Neo International Industries, Ball Ground, Ga.

[21] Appl. No.: 105,050

[22] Filed: Aug. 12, 1993

[51] Int. Cl.[5] ..... F24H 1/10

[52] U.S. Cl. ..... 392/487; 392/489; 392/503

[58] Field of Search ..... 392/485, 486, 487, 488, 392/497, 503, 489; 501/54, 57, 904; 313/578, 579, 636

[56] References Cited

U.S. PATENT DOCUMENTS

| | | | |
|---|---|---|---|
| 2,894,166 | 7/1959 | Mohn | 392/503 |
| 2,934,444 | 4/1960 | Smith | 501/27 |
| 3,274,006 | 9/1966 | McKinnis | 501/27 |
| 3,459,565 | 8/1969 | Jones | 501/54 |
| 3,546,431 | 12/1970 | Gibbs | 392/503 |
| 3,906,188 | 9/1975 | Gamell . | |
| 4,534,282 | 8/1985 | Marinoza . | |
| 4,800,252 | 1/1989 | Steixner | 392/503 |
| 5,054,107 | 10/1991 | Batchelder | 392/483 |
| 5,054,108 | 10/1991 | Gustin et al. | 392/492 |

FOREIGN PATENT DOCUMENTS

| | | |
|---|---|---|
| 867504 | 11/1941 | France . |
| 2539997 | 8/1984 | France . |
| 61-116246 | 6/1986 | Japan . |
| 563945 | 9/1944 | United Kingdom . |

*Primary Examiner*—Teresa J. Walberg
*Attorney, Agent, or Firm*—Cushman Darby & Cushman

[57] ABSTRACT

An infrared electric liquid heater includes an elongated emitter unit contained within an outer containment tube to define an annular volume through which the to-be-heated water flows. The emitter unit includes a tubular silica-composition envelope that comes into direct contact with the water to be heated. A tungsten filament is contained within the envelope and is supported along the longitudinal axis by spaced-apart filament supports. The envelope is fabricated from a silica composition discovered to provide unique structural properties; the envelope drawn from a melt (by volume) of 99.88% to 99.94% pure silica ($SiO_2$), 0.04% to 0.08% crystalline sodium borax ($Na_2B_4O_7.10H_2$), and 0.2% to 0.04% hydroxide of potassium (KOH). This composition has demonstrated a structural strength that allows for a high efficiency in-line, instant-on heater using only a single silica wall separating the electrically energized filament from the liquid being heated. The interior of the envelope is filled with an argon/krypton/hydrogen bromide gas mixture that re-deposits any metallic vapor arising from the filament back onto the surface of the filament to avoid undesired deposition of the material of the filament onto the inner surface of the envelope. The tungsten filament emits strongly between 1μ and 1.2μ in the near-infrared band. The containment tube is provided with a gold-deposited reflective surface to enhance the overall efficiency of the heater.

9 Claims, 2 Drawing Sheets

HIGH-EFFICIENCY INFRARED ELECTRIC LIQUID-HEATER

BACKGROUND OF THE INVENTION

The present invention relates to infrared electric liquid heaters, and, more particularly, to infrared electric water heaters of the type in which an electrically heated filament irradiates a stream of water to increase the water temperature.

Water is typically heated electrically by using immersion-type heaters that are mounted within a water-filled vessel. The generic immersion-type heater includes a resistance wire that is contained within a ceramic matrix which, in turn, is sealed within a metal containment sheath. Electric current is passed through the resistance wire with the heat generated by the wire conducted through the ceramic matrix and the metal sheath into the surrounding water. The heat is transferred primarily by conduction to the water immediately adjacent the containment sheath with the heated water forming convection circuits. These types of heaters are generally well-suited for their intended purpose. Since the immersion heaters rely on conduction as their principal heat transfer mode, they cannot be characterized as fast-acting devices and are not suited for in-line, instant-on water heaters where the water temperature is raised as the water flows from an inlet to and towards an outlet.

Various types of in-line, instant-on water heaters have been proposed. In their simplest form, an elongated immersion-type heater can be introduced into a water-carrying conduit to heat the water as it flows in the conduit. Since the heat transfer mode is primarily by conduction, only that water closest to the hot surface of the heater will undergo a temperature rise. In general, traditional immersion-type heater elements are not optimal in this type of application.

Efforts have been directed toward infrared in-line heaters. In the most straightforward organization, an elongated tubular infrared lamp is mounted along a central axis in a water-carrying conduit. The infrared lamp typically includes a tungsten filament supported within a quartz or silica envelope with the exterior surface of the envelope in direct contact with the water in the conduit. The filament, when energized, emits strongly in the mid-infrared range that is believed to be optimal for heating water by radiant energy. The infrared energy irradiates the water flowing in the confined annular space between the outer surface of the quartz or silica envelope that defines the lamp and the interior surface of the conduit. The interior surface of the conduit is desirably reflective to minimize heat transfer through the conduit and maximize radiant energy flux in the annular volume through which the to-be-heated water flows. In this structural organization, the infrared filament functions to heat the water-contacting surface of its quartz or silica envelope so that water contacting that surface is immediately heated by conduction. Also, the infrared filament also functions to irradiate the flowing water and heat the water as the radiation is absorbed by the flowing water.

While the above-described organization appears to represent sound engineering practice, my past experience has shown that the material of the quartz or silica envelope typically used in the infrared lamp cannot structurally withstand the temperature differentials and thermal stresses involved. For example, it is well known that small amounts of water inadvertently splashed onto the surface of a hot halogen lamp will induce transient stress-gradients that can cause immediate and catastrophic fracture of envelope. As can be appreciated, any breaching of the lamp envelope in an in-line water heater context will allow the water to come into contact with the electrical circuit components. My past attempts to develop an instant-on, in-line heater have been thwarted by problems associated with the inability of the envelope surrounding the filament to withstand the stress associated with the introduction of the to-be-heated water onto the surface of the infrared lamp when the lamp is at temperature.

In an effort to compensate for the afore-described drawback, in-line heaters have interposed another quartz or silica tube around the surface of the infrared lamp. An example of this intermediate-tube construction is shown in FIG. 2 of U.S. Pat. No. 4,534,282 issued to Marinoza on Aug. 13, 1985. While this intermediate tube separates the to-be-heated water from the envelope of the infrared-emitting lamp, the intermediate tube also diminishes the thermal efficiency of the device. My experiments using an intermediate tube surrounding the lamp have demonstrated that the intermediate tube structural organization was not efficient enough for use as an in-line, instant-on water heater. Accordingly, the nature of the quartz or silica material that has historically defined the envelope that surrounds the infrared-emitting filament has prevented the fabrication of a practical, high-efficiency, instant-on in-line heater in which the water to-be-heated is in direct contact with the surface of the envelope that surrounds the filament.

SUMMARY OF THE INVENTION

In view of the above, it is an object of the present invention, among others, to provide an infrared electric liquid heater for use as an in-line, instant-on water heater application.

It is another object of the present invention to provide an infrared electric liquid heater having an silica-composition envelope surrounding the infrared emitter that can withstand contact with water at high temperature without loss of structural integrity.

It is another object of the present invention to provide an infrared electric liquid heater having an silica-composition envelope sufficiently strong so that the need for an intermediate tube surrounding the envelope of the infrared emitting lamp can be eliminated.

In accordance with these objects, and others, a high-efficiency infrared electric liquid heater in accordance with the present invention includes an elongated emitter unit contained within an outer containment tube to define an annular volume through which the to-be-heated liquid, i.e., water, flows. The emitter unit includes a tubular silica-composition envelope that is in direct contact with the water to be heated. An elongated tungsten filament is contained within the envelope and is supported substantially on its longitudinal axis by spaced-apart filament supports. The interior of the envelope is filled with an argon/krypton/hydrogen bromide gas mixture that re-deposits any metallic vapor arising from the hot filament back onto the surface of the filament to avoid undesired deposition of the filament material onto the inner surface of the envelope. The envelope is fabricated from a silica composition discovered to provide unique structural properties in the infrared heater environment, more particularly, the silica composition of the envelope is bottom poured from a melt (by volume) of 99.88% to 99.94% pure silica ($SiO_2$), 0.04% to 0.08% crystalline sodium borax ($Na_2B_4O_7.10H_2$), and 0.2% to 0.04% hydroxide of potassium (KOH). This particular composition has demonstrated a structural strength relative to prior silica compositions that allows for a high efficiency, in-line, instant-on heater using only a single silica wall separating the electrically energized filament from the liquid being heated. In the preferred embodiment, the infrared emitter emits strongly between 1$\mu$ and 1.2$\mu$ in the near-infrared band; this emitted wavelength providing superior thermal efficiency relative to the 2.4$\mu$ region of the mid-infrared band thought to be optimal for heating water. The containment tube is provided with a gold-deposited reflective surface to enhance the overall efficiency of the heater.

The present invention advantageously provides a high-efficiency, instant-on, in-line heater in which the disclosed silica composition allows, for the first time, a heater organization in which the water to be heated can be reliably and safely provided in direct contact with the surface of the envelope that surrounds the filament.

Other objects and further scope of applicability of the present invention will become apparent from the detailed description to follow, taken in conjunction with the accompanying drawings, in which like parts are designated by like reference characters.

DESCRIPTION OF THE PREFERRED EMBODIMENT

Figure 1:
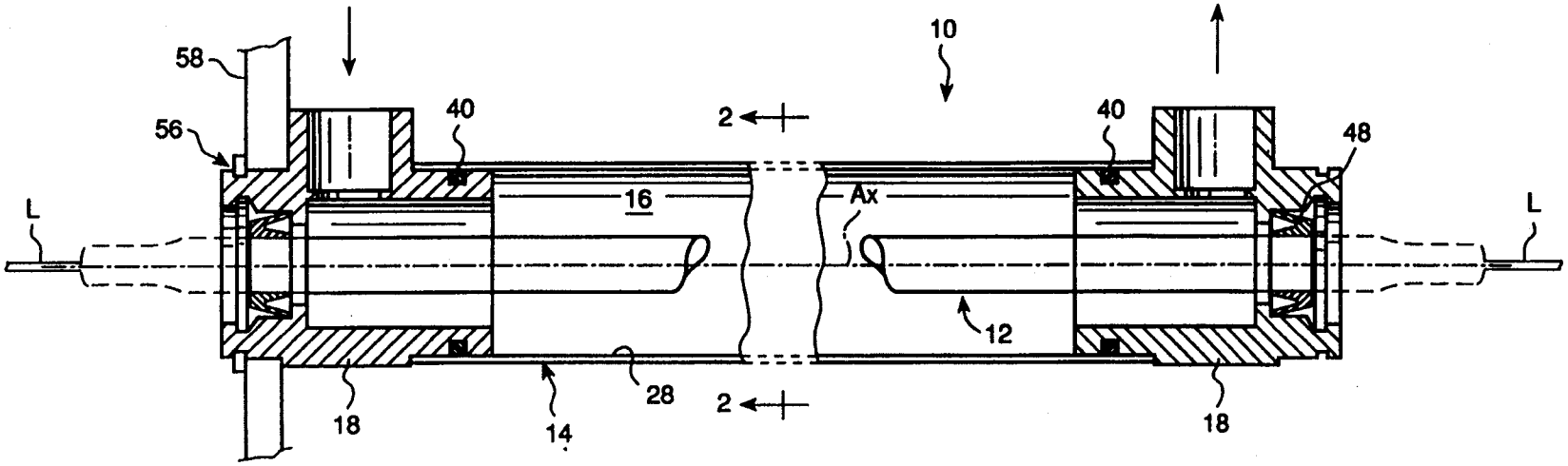
FIG. 1 is a side view, in cross-section, of a representative infrared electric liquid heater in its most general form.
Figure 2:
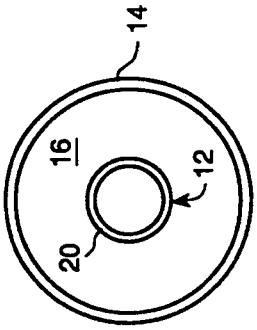
FIG. 2 is an enlarged cross-section view of the heater of FIG. 1 taken along line 2—2 of FIG. 1.

An infrared electric liquid heater assembly in accordance with the present invention is shown in longitudinal cross-section in FIG. 1 and in transverse cross-section in FIG. 2 and is designated generally therein by the reference character 10. As shown, the heater assembly 10 is formed as an elongated structure about a longitudinal axis $A_x$ and includes an emitter unit 12 aligned coaxially with the longitudinal axis $A_x$, a cylindrical outer tube 14 surrounding the emitter unit 12 in a concentric matter to define an intermediate annular volume 16, and end caps 18 that maintain the emitter unit 12 and the outer tube 14 in their intended coaxial relationship. As described in more detail below, the end caps 18 function as fluid manifolds so that the fluid to be heated, i.e., water, is introduced into the annular volume 16 through one of the end caps 18 to flow longitudinally in the annular volume 16 toward and to the other end cap 18 while the fluid is heated by infrared energy.

Figure 3:
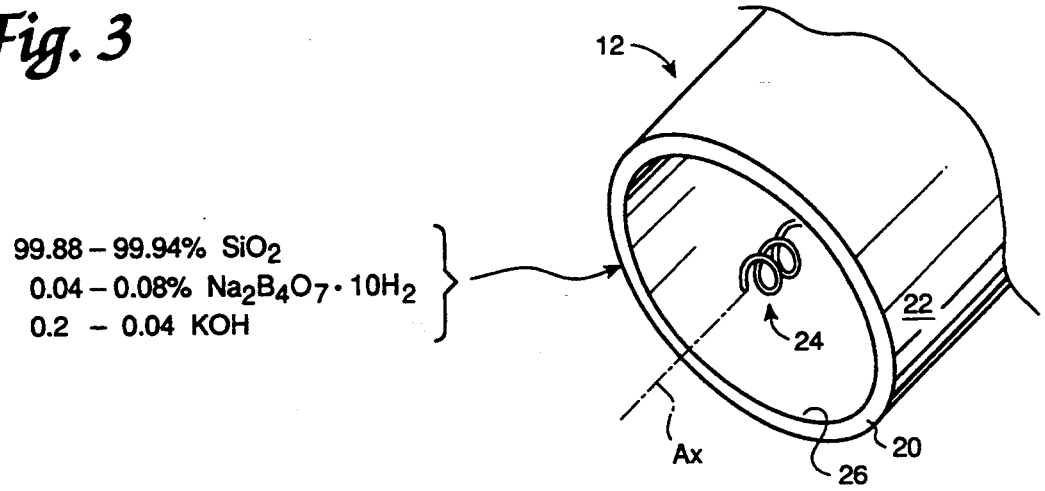
FIG. 3 is an enlarged perspective view, in cross-section, section, of the infrared emitter unit illustrating the filament and one of its supports.

As shown in the cross-sectional perspective view of FIG. 3, the emitter unit 12 includes a tubular envelope 20 having an exterior surface 22 that establishes the inner boundary the annular volume 16. A tungsten filament 24 is contained within the envelope 20 and is supported substantially on the longitudinal axis $A_x$ by spaced apart filament supports of conventional design (not shown). Each filament support is fabricated from temperature resistant metal wire shaped in a spiral form with the filament 24 carried in the centermost convolution of the filament support and with the outermost convolution of the filament support resiliently engaging the interior surface 26 of the envelope 20. The filament 24 is typically formed as a continuous helix section intermediate straight end portions. In the preferred embodiment, the helical formation has a diameter of about 0.100 inches with the filament wire having a 0.036 inch diameter. When electrical current flows through the filament 24, its surface temperature is in the range of 4600° F. As shown in dotted-line illustration in FIG. 1, the opposite ends of the envelope 20 are thermally collapsed around and about the straight end portions L to form a sealed volume, as is conventional in the art. The end portions L are connected with a source of electrical energy.

The interior of the envelope 20 is filled with a gas mixture that has been found particularly beneficial to the long-term operation of the heater assembly 10 and which tends to redeposit any metallic vapor arising from the filament 24 back onto the surface of the filament 24 to thus avoid undesired deposition of the material of the filament 24 onto the inner surface of the envelope 20. As can be appreciated, any deposition or "plating" of the material of the filament 24 onto the interior surface of the envelope 20 will diminish the efficiency of the heater assembly 10 with continued use. In addition, the gas mixture tends to increase the thermal efficiency of the heater assembly 10 when used for heating water. The particular gas mixture found to be optimal for the intended purpose of the heater assembly 10 is 99.67% to 99.8% argon, 0.1% to 0.15% krypton, and 0.1 to 0.18% hydrogen bromide (all percentages by volume). The envelope 20 is normally sealed with gas mixture at a pressure of about one atmosphere (gauge) with this pressure rising to approximately 180–200 psi at temperature. In practice, this gas composition is believed to provide a useful life of more than 10 years for the emitter unit 12.

The envelope 20 is fabricated from a silica composition discovered by me to provide unique structural properties in the intended environment so that a higher efficiency device can be obtained compared to the prior art. In the preferred embodiment, the envelope 20 is between 25 and 28 inches long with an outside diameter of between 0.3934 and 0.4308 inches and a wall thickness of about 0.025 to 0.030 inches. The silica composition for the envelope is bottom poured from a melt of 99.88% to 99.94% pure silica ($SiO_2$), 0.04% to 0.08% crystalline sodium borax ($Na_2B_4O_7.10H_2$), and 0.2% to 0.04% hydroxide of potassium (KOH) (all percentages by volume). Envelopes 20 custom manufactured from this composition have been provided to me by Sylvania Lighting Products of Franklin, Ky. The resulting composition has demonstrated a unique structural strength that allows for a high efficiency heater assembly 10 using only a single wall separating the electrically energized filament 24 from the liquid being heated to thus dispense with the intermediate tube used in the prior art and by me. For example, the emitter unit 12 can be energized without any liquid being present in the annular volume 16 and maintained in that energized state until all surfaces are fully heated. In this operating state, the exterior of the envelope can attain a temperature of between 800° F. and 900° F. Thereafter, cool unheated liquid (i.e., 55° F. and 75° F.) can be quickly introduced into the annular volume 16 without any danger of the fracture of the aforedescribed silica composition. In a similar manner, the liquid in the annular volume 16 can be allowed to fully vaporize without danger of the envelope 20 fracturing. The silica composition allows, for the first time, a structural organization in which high thermal efficiencies can be achieved without danger of the catastrophic failure experienced in the past. Experience has shown that prior art silica or glass compositions other than that described will suffer fracture and structural failure in the operating environment of the present invention.

The emitter unit 12 is designed to emit strongly between 1μ and 1.2μ in the near-infrared band with the latter value consider optimum. In my experience, efficiency drops when the emitted radiation is below 1μ and above 2μ. It has been generally assumed that irradiation in the 2.4μ region of the mid-infrared band is optimal for the heating of water. For reasons not entirely understood by me, heating efficiency in the 2.4μ range is about 75% of that provided at wavelengths between 1μ and 1.2μ in the near-infrared band with 1.2μ discovered to be optimal.

The outer tube 14 is fabricated from a cylindrical brass or aluminum tube that is substantially co-extensive in length with the emitter unit 12 and held in a concentric relationship with the emitter unit 12 by the end caps 18. The interior surface 28 of the outer tube 14 has a gold reflective layer deposited on it to reflect and return radiation from the emitter unit 12. Gold is the preferred reflective material since it has a high reflectivity (i.e., approximately 97% to 98%) in the infrared range of interest and is readily deposited in accordance with known techniques. While gold is preferred, other reflective coatings, i.e., anodized aluminum, having similar functional characteristics are suitable. Where anodized aluminum is used, the starting tube is cleaned, subjected to a bright dip, recleaned, and subject to a hard clear anodizing step. Thereafter, the anodized area is colored with a commercially available metallic coloring agent. Where the heater assembly 10 is used for heating water, an outer tube 14 having an inside diameter of 1.180 inches and an outside diameter of 1.250 inches has been found optimal; diameters of between 0.875 and 1.5 inches for the outer tube 14 are suitable with thermal efficiency decreasing rapidly for outer tubes smaller than 0.875 inches and larger than about 1.5 inches in diameter.

Figure 4A:
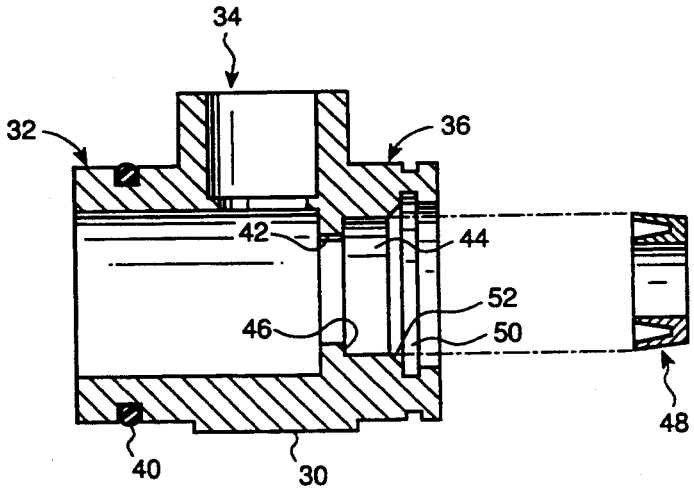
FIG. 4A is a side-elevational view, in cross-section, of an end cap.
Figure 4B:
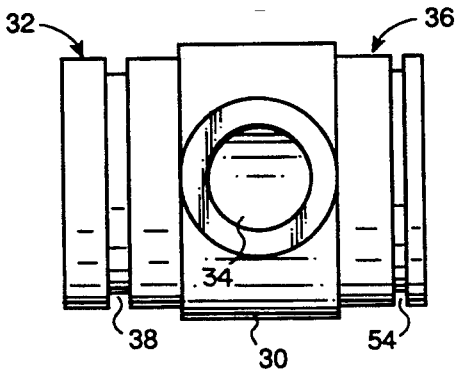
FIG. 4B is a top view of the end cap shown in FIG. 4A.

Each end cap 18 is formed as a unitary part and designed to retain the emitter unit 12 and the outer tube 14 in a liquid-tight concentric relationship with one another as well as provide an inlet/outlet port for the heated liquid. As shown in FIGS. 4A and 4B, each end cap 18 includes a main body portion 30, cylindrical stub 32, a fluid port 34, and a seal-receiving end 36. The cylindrical stub 32 has an outside diameter somewhat less than the inside diameter of the outer tube 14 to define a sliding fit between the parts so that the cylindrical stub 32 will be received within the outer tube 14. A circumferential O-ring groove 38 is formed on the peripheral surface of the cylindrical stub 32 and receives an O-ring 40 so that a liquid-tight relationship is maintained between the cylindrical stub 32 and the outer tube 14. The fluid port 34 communicates with the hollow interior of the end cap 18 at a right angle to the longitudinal axis $A_x$. While not specifically shown, the fluid port 34 can be provided in various threaded configurations for connection to liquid-carrying conduits, as desired. The seal-receiving end 36 extends along the longitudinal axis $A_x$ and includes a through-bore 42 and a concentric counterbore 44 that define a shoulder 46 transverse to longitudinal axis $A_x$. A chevron-type seal 48 is positioned in the counterbore 44 and seated against the shoulder 46 and provides a liquid-tight seal between the outside diameter of the envelope 20 and the interior of the end cap 18. A chevron-type seal is preferred since it can easily accommodate changes in dimension of the emitter unit 12 over the temperature range of the heater assembly 10. An interior circumferential groove 50 is formed adjacent the counterbore 44 and is provided with internal retaining ring (not shown) to maintain the seal 48 in its assembled position. If desired the region between the counterbore 44 and the interior circumferential groove 50 is conically tapered (at 52) to ease entry of the seal 48 into the counterbore 50. A circumferential external groove 54 is formed on the peripheral surface of the seal-receiving end 36 and receives an external retaining ring 56 (FIG. 1) so the end cap 18 can be retained in a mounting bracket 58 (partially illustrated). The end cap 18 can be fabricated from any suitable material including aluminum, for example.

In a preferred embodiment of the heater assembly 10 having the component dimensions mentioned above and a 15KW rating, relatively cold input water having a temperature between 55° F. and 75° F. and a flow rate of 4 gal/min typically underwent a temperature increase of 30° F. with the filament 24 operated at a 240 VAC and drawing about 62.5 amps. Under these circumstances, the water attained this increase in temperature in 12 seconds after power-on and continuously delivered heated water thereafter. During continued operation, the exterior of the outer tube 14 remained warm to the touch but never became hot.

The basic heater assembly 10 described above can be serially connected in a multiple unit design to provide successive increases in temperature as the water flows through each successive heater assembly 10 in the series. For example, four heater assemblies 10 can be connected in series flow with a thermostat placed in the outlet stream of the last heater assembly in the series to control current flow to the electrically paralleled filaments. As can be appreciated, individual heater assemblies 10 can be readily 'ganged' in various serial/parallel flow paths as desired.

Because of the unexpected strength exhibited by the particular silica composition described above and as demonstrated by my tests, the emitter unit 12 can be switched-on at full power without any water present in the annular volume 16 with relatively cool water (i.e., between 55° F. and 75° F.) subsequently introduced at full flow rates into the annular volume 16 without danger of fracture. Additionally, where the throughflow is intentionally halted, the water in the annular volume 16 can be boiled off without apparent adverse affect on the envelope 20 of the emitter unit 12. My experience has shown that all prior silica compositions tested by me failed to meet the performance criteria established by the above described silica composition.

As will be apparent to those skilled in the art, various changes and modifications may be made to the illustrated infrared electric liquid heater of the present invention without departing from the spirit and scope of the invention as determined in the appended claims and their legal equivalent.

What is claimed is:

1. An infrared electric liquid heater comprising:

a conduit for carrying a liquid from an inlet to an outlet;

an infrared radiant emitter contained within said conduit for heating the liquid carried in said conduit;

said emitter having a silica-composition envelope in direct contact with the liquid to be heated and an electrically heated filament sealed within the envelope for providing infrared energy through the envelope into the liquid, said silica-composition drawn from a melt of 99.88% to 99.94% pure silica ($SiO_2$) by volume, 0.04% to 0.08% crystalline sodium borax ($Na_2B_4O_7.10H_2$) by volume, and 0.2% to 0.04% hydroxide of potassium (KOH) by volume, the silica composition having sufficiently high structural strength to remain intact when contacted by cool water when the surface of said envelope is at or above 800° F.

2. The infrared electric liquid heater of claim 1, further comprising an argon, krypton, and hydrogen bromide gas mixture within said envelope.

3. The infrared electric liquid heater of claim 2, wherein said gas mixture comprises:

99.67% to 99.8% argon, 0.1% to 0.15% krypton, and 0.1 to 0.18% hydrogen bromide.

4. The infrared electric liquid heater of claim 1, wherein said filament emits strongly between the 1$\mu$ and 1.2$\mu$ region of the infrared band.

5. The infrared electric liquid heater of claim 1, wherein said conduit has a diameter between 0.875 inches and 1.5 inches.

6. The infrared electric liquid heater of claim 5, wherein the interior surface of said conduit facing said emitter is conditions to have at least a 95% reflectivity in the infrared band.

7. The infrared electric liquid heater of claim 3, further comprising:

end caps for removeably maintaining the conduit and emitter in a concentric liquid-tight relationship.

8. The infrared electric liquid heater of claim 7, wherein said end caps further comprises:

a removeable seal of liquid-tight engagement of the end portion of the emitter.

9. The infrared electric liquid heater of claim 8, wherein said removeable seal comprises a chevron seal.

* * * * *